US008794622B2

(12) United States Patent
Obuchi et al.

(10) Patent No.: US 8,794,622 B2
(45) Date of Patent: Aug. 5, 2014

(54) SHEET STACKING DEVICE AND IMAGE FORMING APPARATUS

(75) Inventors: Yusuke Obuchi, Abiko (JP); Yasuo Fukatsu, Abiko (JP); Naoto Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 12/323,252

(22) Filed: Nov. 25, 2008

(65) Prior Publication Data

US 2009/0134572 A1 May 28, 2009

(30) Foreign Application Priority Data

Nov. 26, 2007 (JP) ..... 2007-305129
Oct. 16, 2008 (JP) ..... 2008-267214

(51) Int. Cl.
*B65H 31/04* (2006.01)

(52) U.S. Cl.
USPC ..... 271/214; 271/213; 271/217; 271/156

(58) Field of Classification Search
USPC ..... 271/213, 214, 215, 217, 218, 156, 157
See application file for complete search history.

(56) References Cited

U.S. PATENT DOCUMENTS

| | | | | |
|---|---|---|---|---|
| 3,764,129 | A * | 10/1973 | Yanagawa | 271/156 |
| 4,068,839 | A * | 1/1978 | Bullock et al. | 271/180 |
| 6,736,584 | B2 * | 5/2004 | Dehn et al. | 414/396 |
| 2005/0285334 | A1 * | 12/2005 | Sato et al. | 271/303 |

FOREIGN PATENT DOCUMENTS

| | | | |
|---|---|---|---|
| JP | 56-056457 | A | 5/1981 |
| JP | 06-144682 | A | 5/1994 |
| JP | 2006-036533 | | 2/2006 |
| JP | 2006-124052 | | 5/2006 |
| JP | 2006-213492 | A | 8/2006 |
| JP | 2008-094583 | A | 4/2008 |

* cited by examiner

*Primary Examiner* — Ernesto Suarez
(74) *Attorney, Agent, or Firm* — Canon U.S.A., Inc. IP Division

(57) ABSTRACT

A stacker includes a plurality of sheet stacking units individually movable upward and downward. Sheets are selectively stacked onto either of the stacker trays. To remove the sheets stacked on one of the stacker trays, a door is opened. In a state where the door is open, the stacker trays moved by respective elevation units are movable only downward. In this manner, accidental upward movement of each of the stacker trays caused by a malfunction of a motor or the like is regulated, whereby damage to the stacker is prevented.

6 Claims, 17 Drawing Sheets

SHEET STACKING DEVICE AND IMAGE FORMING APPARATUS

BACKGROUND OF THE INVENTION

1. Field of the Invention

The present invention relates to sheet stacking devices in which a large number of sheets that are discharged thereto can be stacked and image forming apparatuses including such sheet stacking devices.

2. Description of the Related Art

With the advancement in technology, recently developed image forming apparatuses form images on sheets at an increasing speed. With such an increase in image forming speed, the speed of discharging sheets from the body of an image forming apparatus is also increasing. For the purpose of aligning and stacking a large number of sheets that are discharged at a high speed, there are some image forming apparatuses each including a large-capacity stacker device, a sheet stacking device, as disclosed in Japanese Patent Laid-Open No. 2006-124052.

FIG. 17 shows an exemplary known large-capacity stacker device. A stacker device 500 includes a gripper 503 that is attached to a conveying belt 508 rotating clockwise and moves along with the rotation of the conveying belt 508 while holding the leading end of a sheet, whereby the sheet is conveyed.

In the stacker device 500 having such a configuration, a sheet that is discharged from the body of an image forming apparatus (not shown) is first received by an entrance roller 501. Then, the leading end of the sheet is delivered by a conveying roller 502 to the gripper 503, and the conveying belt 508 rotates. In response to this, the gripper 503, which is holding the leading end of the sheet in combination with the conveying belt 508, moves along with the rotation of the conveying belt 508, whereby the sheet is conveyed above a sheet stacking table 505.

When the leading end of the sheet knocks against a leading end stopper 504, holding of the sheet by the gripper 503 is released, whereby the sheet falls and is stacked onto the sheet stacking table 505. Every time a sheet is stacked onto the sheet stacking table 505, an aligning unit (not shown) makes a jogging motion in a direction perpendicular to a sheet conveying direction (hereinafter denoted as the width direction) so as to align both sides of the sheet. Thus, alignment of stacked sheets is improved.

The stacker device 500 also includes a leading-end-pressing member 506 and a trailing-end-pressing member 507 that press the leading end and the trailing end, respectively, of a sheet stack SA on the sheet stacking table 505. While sheets are being stacked, the sheet stack SA is pressed by the leading-end-pressing member 506 and the trailing-end-pressing member 507 against the sheet stacking table 505 every time the number of sheets that have been stacked reaches a predetermined number. This facilitates discharging of subsequent sheets.

The stacker device 500 also includes a sheet surface detection sensor (not shown) configured to detect the position of the top surface of the sheet stack SA on the sheet stacking table 505. In accordance with a detection signal generated by the sheet surface detection sensor, the sheet stacking table 505 is lowered so that the top surface of the sheet stack SA on the sheet stacking table 505 is maintained at a level within a predetermined range. This enables continuous sheet discharge.

To remove the sheet stack SA on the sheet stacking table 505, an eject button is pressed, whereby the sheet stacking table 505 having the sheet stack SA thereon is lowered and is placed onto a dolly 509. After the sheet stacking table 505 is placed on the dolly 509, the dolly 509 is pulled out frontward in the depth direction in FIG. 17, whereby the sheet stack SA can be removed.

In the stacker device 500 having such a configuration, the sheet stack SA cannot be removed unless the sheet stacking operation of the stacker device 500 is stopped. Consequently, the image forming apparatus itself needs to be stopped to remove the sheet stack SA, leading to a reduction in productivity.

To avoid such a situation, an image forming apparatus connected to a plurality of sheet stacking devices is disclosed in Japanese Patent Laid-Open No. 2006-036533 (US Unexamined Patent Application Publication No. 2005/285334). In this image forming apparatus, when one of the sheet stacking devices becomes full of sheets, subsequent sheets are stacked in another sheet stacking device. Such a configuration enables a continuous sheet stacking operation. Thus, reduction in productivity can be prevented.

In the stacker device 500, the sheet stacking table 505 is raised or lowered by a motor controlled by a control unit, in such a manner as to be moved within a predetermined range. If the motor causes a malfunction because of electrical noise or the like, the sheet stacking table 505 may be moved beyond the predetermined range. To avoid such a situation, the known stacker device 500 includes a limiting mechanism that limits the sheet stacking table 505 not to be raised or lowered beyond the predetermined range. The limiting mechanism is provided on the body of the stacker device 500 and includes upper and lower stoppers. The sheet stacking table 505 is forcibly stopped when part of the sheet stacking table 505 knocks against the upper or lower stopper.

The known stacker device 500, however, has the following problem. The sheet stacking table 505 is lowered and is placed on the dolly 509 when a large number of sheets stacked thereon is removed. If the motor causes a malfunction in lowering the sheet stacking table 505, the sheet stacking table 505 that should be lowered may be accidentally raised. In the known stacker device 500, since the upper stopper limits the movement of the sheet stacking table 505 by having a direct contact therewith, the top of a sheet stack, if any, on the sheet stacking table 505 may bump into upper parts of the stacker device 500 before the sheet stacking table 505 is stopped by the upper stopper, leading to damage.

To avoid this problem, the sheet surface detection sensor provided to the stacker device 500 for detecting the position of the top surface of the sheet stack on the sheet stacking table 505 may be used so as to stop the upward movement of the sheet stacking table 505 due to malfunction in accordance with the detection by this sensor. Also in this case, however, the sheet surface detection sensor may likewise cause a malfunction because of electrical noise and become incapable of responding to a malfunction of the motor, resulting in incapability of stopping the upward movement of the sheet stacking table 505.

SUMMARY OF THE INVENTION

In light of the above, the present invention provides a sheet stacking device and an image forming apparatus capable of assuredly preventing damage to the device brought by malfunction of a sheet stacking table.

According to an aspect of the present invention, a sheet stacking device includes a sheet stacking unit configured to be movable upward and downward, an elevation unit configured to raise and lower the sheet stacking unit, a door configured to be opened when sheets stacked on the sheet stacking unit are removed, a drive source configured to drive the elevation unit, and a transmission unit transmitting driving forces of the drive source to the elevation unit to raise and lower the sheet stacking unit. In a state where the door is open, the transmission unit transmits to the elevation unit only the driving force of the drive source to lower the sheet stacking unit.

Further features of the present invention will become apparent from the following description of exemplary embodiments with reference to the attached drawings.

DESCRIPTION OF THE EMBODIMENTS

Embodiments of the present invention will now be described in detail with reference to the drawings.

Figure 1:
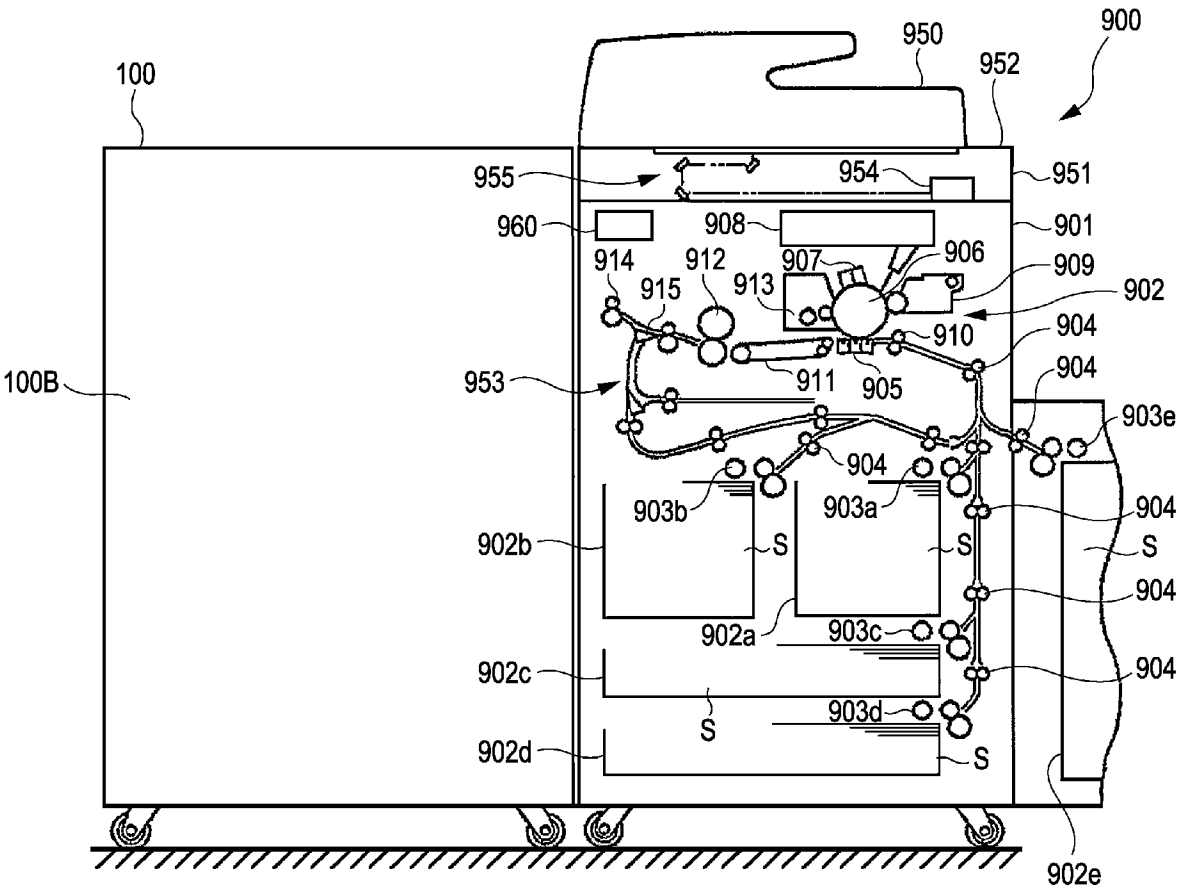
FIG. 1 shows an image forming apparatus including a sheet stacking device according to an embodiment of the present invention.

FIG. 1 shows an image forming apparatus including a sheet stacking device according to an embodiment of the present invention.

Referring to FIG. 1, an image forming apparatus 900 includes a body 901 and an image reader 951 disposed atop of the body 901. The image reader 951 includes a scanner unit and an image sensor 954. The image forming apparatus also includes a document feeder 950 disposed atop of the image reader 951. The document feeder 950 feeds a document to a platen glass 952.

The image forming apparatus 900 also includes in the middle section of the body 901 an image forming section that forms an image on a sheet and a sheet turner 953. The image forming section 902 includes a cylindrical photoconductive drum 906, a charger 907, a developer 909, a cleaner 913, and so forth. Further, a fuser 912, a pair of discharging rollers 914, and so forth are provided on the downstream side with respect to the image forming section 902.

The body 901 of the image forming apparatus 900 is connected to a stacker 100. The stacker 100 is a sheet stacking device in which sheets having images formed thereon and being discharged from the body 901 of the image forming apparatus 900 are stacked. A controller 960 controls the operations of the body 901 and the stacker 100. The stacker has a front door 100B. The front door 100B is opened when sheets stacked on a stacker tray, which will be described separately below, provided in the stacker 100 are removed.

Next, an image forming operation performed in the body 901 of the image forming apparatus 900 configured as above will be described.

When an image forming signal is output from the controller 960, a document is placed on the platen glass 952 by the document feeder 950. An image on the document is read by the image reader 951 as digital data. The digital data is input to an exposure unit 908. The exposure unit 908 exposes the photoconductive drum 906 with light in accordance with the digital data.

Prior to the exposure, the surface of the photoconductive drum 906 is uniformly charged by the charger 907. Therefore, when the photoconductive drum 906 is exposed to light as described above, an electrostatic latent image is formed on the surface of the photoconductive drum 906. The electrostatic latent image is developed by the developer 909, whereby a toner image is formed on the surface of the photoconductive drum 906.

On the other hand, when a sheet feeding signal is output from the controller 960, a sheet S that is set in any of cassettes 902*a* to 902*d* and a sheet feeding deck 902*e* is conveyed by a corresponding one of sheet feeding rollers 903*a* to 903*e* through pairs of conveying rollers 904 to a resist roller 910.

The resist roller 910 conveys the sheet S to a transfer section including a transfer/detach charger 905 in such a manner that the leading end of the sheet S matches the leading end of the toner image on the photoconductive drum 906. In the transfer section, a transfer bias is applied to the sheet S by the transfer/detach charger 905, whereby the toner image on the photoconductive drum 906 is transferred to the sheet S.

The sheet S having the toner image transferred thereon is conveyed by a conveying belt 911 to the fuser 912, and is further conveyed while being nipped between a heating roller and a pressing roller included in the fuser 912, whereby the toner image is fixed with heat. Foreign substances including toner remaining on the photoconductive drum 906 without being transferred to the sheet S are scraped off by a blade of the cleaner 913. Thus, the photoconductive drum 906 is cleaned and is ready for a subsequent image forming operation.

The sheet S having the toner image fixed thereon is further conveyed by the pair of discharging rollers 914 to the stacker 100, or is directed by a flapper 915 to the sheet turner 953, where another image forming operation is performed.

Figure 2:
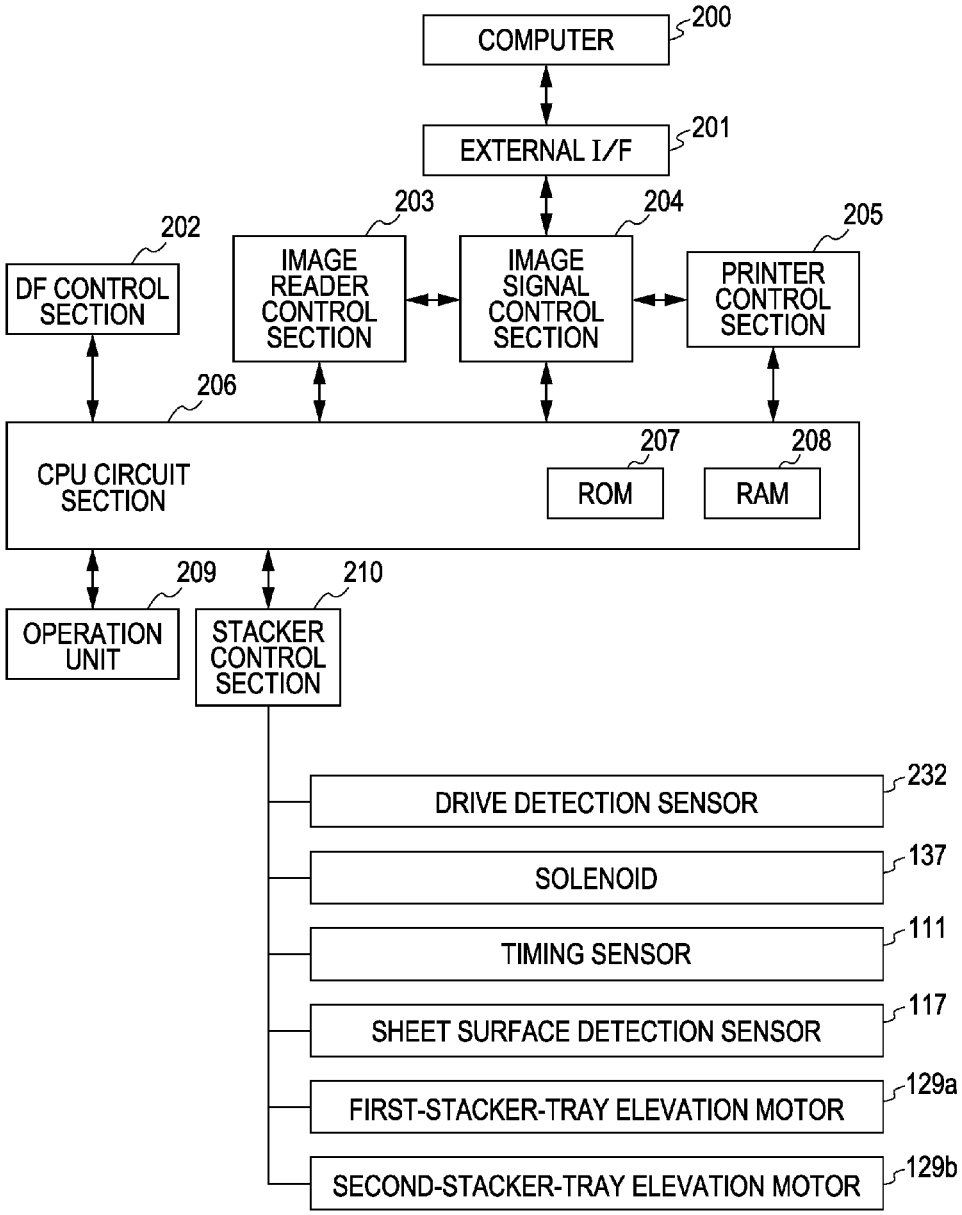
FIG. 2 is a control block diagram of a controller provided in the image forming apparatus.

FIG. 2 is a block diagram of the controller 960. The controller 960 includes a central-processing-unit (CPU) circuit section 206. The CPU circuit section 206 includes a CPU (not shown), a read-only memory (ROM) 207, and a random access memory (RAM) 208. The CPU circuit section 206 generally controls a document feed (DF) control section 202, an operation unit 209, an image reader control section 203, an image signal control section 204, a printer control section 205, and a stacker control section 210 in accordance with a control program stored in the ROM 207. The RAM 208 temporarily stores control data and is used as a workspace for arithmetic processing accompanied by the control operation.

The DF control section 202 drives and controls the document feeder 950 in accordance with an instruction given by the CPU circuit section 206. The image reader control section 203 drives and controls components such as the scanner unit 955 and the image sensor 954 included in the image reader 951, thereby transferring to the image signal control section 204 an analog image signal that is output from the image sensor 954.

The image signal control section 204 converts the analog image signal from the image sensor 954 into a digital signal, converts the digital signal into a video signal by performing appropriate processing thereto, and outputs the video signal to the printer control section 205.

The image signal control section 204 also receives a digital image signal from a computer 200 or from an external terminal through an external interface (I/F) 201, performs appropriate processing to the digital image signal, converts the digital image signal into a video signal, and outputs the video signal to the printer control section 205. Such processings performed by the image signal control section 204 are controlled by the CPU circuit section 206.

The printer control section 205 drives the exposure unit 908 via an exposure control section (not shown) in accordance with the video signal that is input to the printer control section 205. The operation unit 209 includes a plurality of keys with which various parameters relating to image formation are set, a display on which information indicating parameters that are set is displayed, and so forth. Further, the operation unit 209 outputs a key signal corresponding to each key operation to the CPU circuit section 206 while displaying information corresponding to the signal obtained from the CPU circuit section 206 on the display.

The stacker control section 210 is provided in the stacker 100, and drives and controls the entirety of the stacker 100 on the basis of communication with the CPU circuit section 206. The stacker control section 210 is connected to an elevation motor 129 (129*a* & 129*b*), a drive detection sensor 232, a solenoid 137, and a timing sensor 111.

The stacker control section 210 is also connected to a first-stacker-tray elevation motor 129*a*, a second-stacker-tray elevation motor 129*b*, a sheet surface detection sensor 117, and so forth. The control operation performed by the stacker control section 210 to such components will be described separately below. The stacker control section 210 may be integrally provided in the CPU circuit section 206 included in the body 901 of the image forming apparatus 900 so that the stacker 100 can be controlled directly from the body 901 of the image forming apparatus 900.

Figure 3:
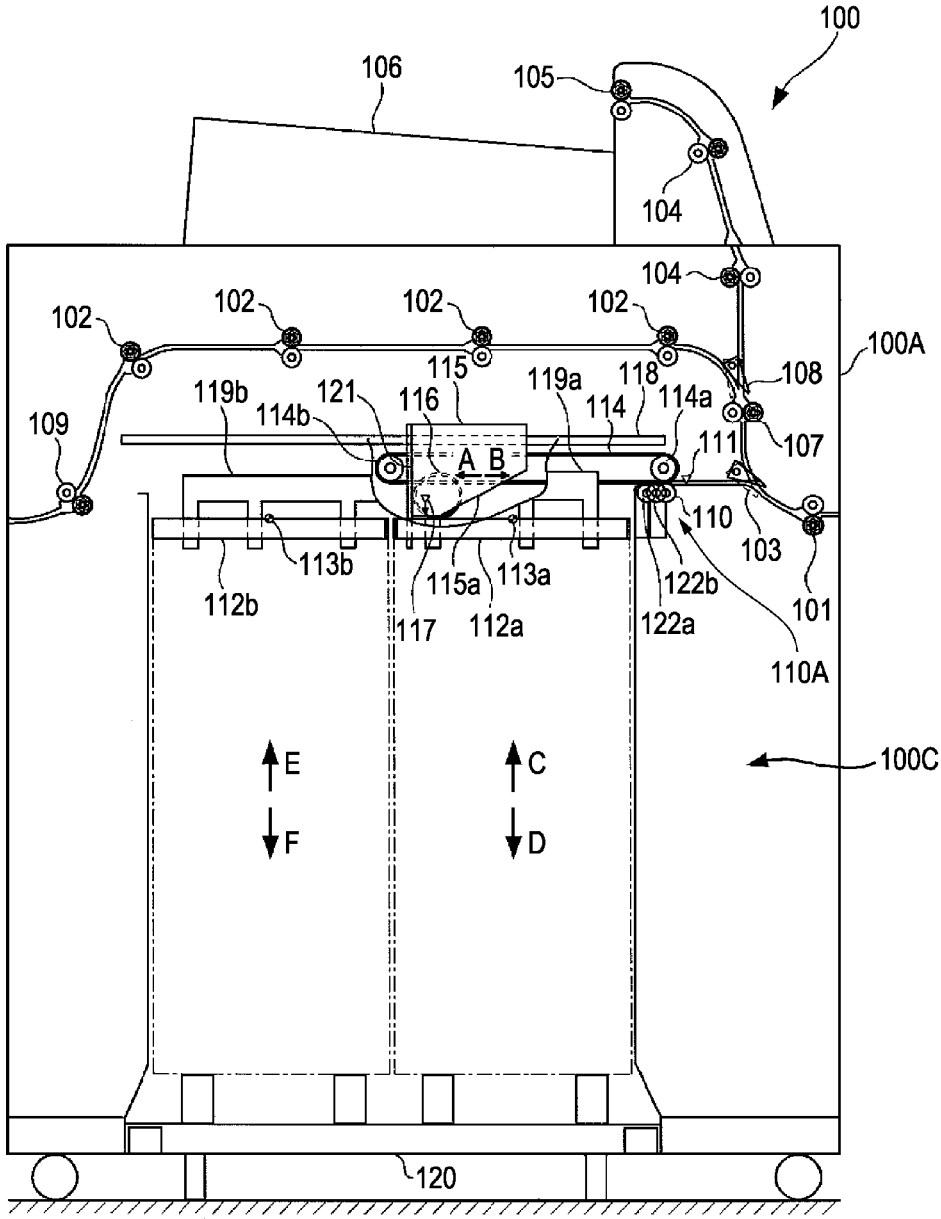
FIG. 3 shows the stacker.

FIG. 3 shows the stacker 100. The stacker 100 includes a top tray 106 on which sheets that are discharged from the body 901 of the image forming apparatus 900 are to be stacked. The stacker 100 also includes a stacking section 100C, a sheet stacking section, in which two (a plurality of) stacker trays (hereinafter referred to as first and second stacker trays, respectively) 112*a* and 112*b* arranged side by side in the sheet discharging direction, so that a large number of sheets can be stacked without increasing the size of the device.

When sheets of small size such as A4 are discharged, the sheets can be selectively stacked onto any of the plurality of stacker trays, i.e., the first stacker tray 112*a* and the second stacker tray 112*b* in this embodiment, whereby a large stacking capacity is realized. In a case of stacking sheets of large size such as A3, the sheets are stacked over the entirety of both the first and second stacker trays 112*a* and 112*b*, whereby stacking of large-sized sheets is realized.

The first and second stacker trays 112*a* and 112*b* can be individually raised and lowered by the first-stacker-tray elevation motor 129*a* and the second-stacker-tray elevation motor 129*b* (see FIG. 2) in directions indicated by the arrows C and D and the arrows E and F.

The stacker 100 also includes a first redirecting member 103, which is driven by a solenoid (not shown) and directs a sheet S conveyed into the stacker 100 to the stacking section 100C or another sheet stacking unit, i.e., the top tray 106. In FIG. 3, if the destination of sheet discharge is a sheet processing device (a stacker device, not shown) disposed on the downstream side of the stacker 100, a second redirecting member 108 is driven by a solenoid (not shown) to turn to a position shown in solid lines.

The stacker 100 shown in FIG. 3 includes a body 100A and a sheet guiding unit 115 that guides a sheet that is discharged from a pair of discharging rotary members 122A, which is a sheet discharging unit described separately below, toward the stacker trays 112*a* and 112*b*. The sheet guiding unit 115 includes a knurled belt 116 rotating clockwise and having resilience with which a sheet is drawn in to a position above the stacker trays 112*a* and 112*b*, and a leading end stopper 121 serving as a stopper that determines the position of the sheet in the sheet discharging direction.

The sheet guiding unit 115 is configured such that a sheet that is discharged thereto is drawn by the knurled belt 116 into a position between the knurled belt 116 and the first stacker tray 112*a* (or the second stacker tray 112*b*) and then is made to knock against the leading end stopper 121. Thus, sheets can be stacked while the leading end of each sheet that is discharged is positioned with reference to the first or second stacker tray 112*a* or 112*b*.

The sheet guiding unit 115 is mounted on a slide shaft 118 slidably in directions indicated by the arrows A and B and is movable to a position matching the sheet size while being driven by a guiding unit driving motor (not shown). The sheet guiding unit 115 includes a frame having a tapered portion 115*a* so as to guide the sheet that is discharged thereto to the knurled belt 116.

The sheet surface detection sensor 117 is provided for maintaining a constant interval between the sheet guiding unit 115 and the top surface of the stack of sheets. A signal from the sheet surface detection sensor 117 is input to the stacker control section 210 (see FIG. 2). In this embodiment, the top surface of the stack of sheets is set to be at a level below a pair of conveying rollers 110A so that, in a case where some of the stacked sheets are curled upward, the leading end of a subsequent sheet is not stopped at the pair of conveying rollers 110A.

Home position detection sensors 113*a* and 113*b* detect the home positions of the first and second stacker trays 112*a* and 112*b* at the start of initial operation. During the sheet stacking operation, the home position detection sensors 113*a* and 113*b* also function as sheet surface detection sensors for the first and second stacker trays 112*a* and 112*b*, respectively.

The sheet discharging operation is started in a state where the first and second stacker trays 112*a* and 112*b* are at their home positions on the basis of the detection by the home position detection sensors 113*a* and 113*b*, so that sheets can be stacked in a state shown in FIG. 3. When the first and second stacker trays 112*a* and 112*b* are at the home positions, respective sheet stacking surfaces of the first and second stacker trays 112*a* and 112*b* are positioned at the same level.

A discharge belt 114 is stretched between a driving roller 114*a* and a driven roller 114*b* and is rotatable clockwise with the aid of an discharge belt motor (not shown). With the discharge belt 114, sheets are discharged and stacked onto the first or second stacker trays 112*a* or 112*b*. A driven roller 110 is pressed against the discharge belt 114, whereby the driven roller 110 and the discharge belt 114 serve as the pair of conveying rollers 110A.

Extension rollers 122*a* and 122*b* are movable in the sheet discharging direction. When sheets are discharged onto the second stacker tray 112*b*, the extension rollers 122*a* and 122*b* are moved by a drive unit (not shown) to respective positions shown in FIG. 7, which will be described separately below.

The extension roller 122*a* is moved while drawing out a reel film 123, shown in FIG. 7 and described separately below, whose top surface forms a sheet conveying path. Thus, the sheet conveying path is extended. The discharge belt 114 and the extension roller 122*a* constitute the pair of discharging rotary members 122A (see FIG. 8).

Figure 4:
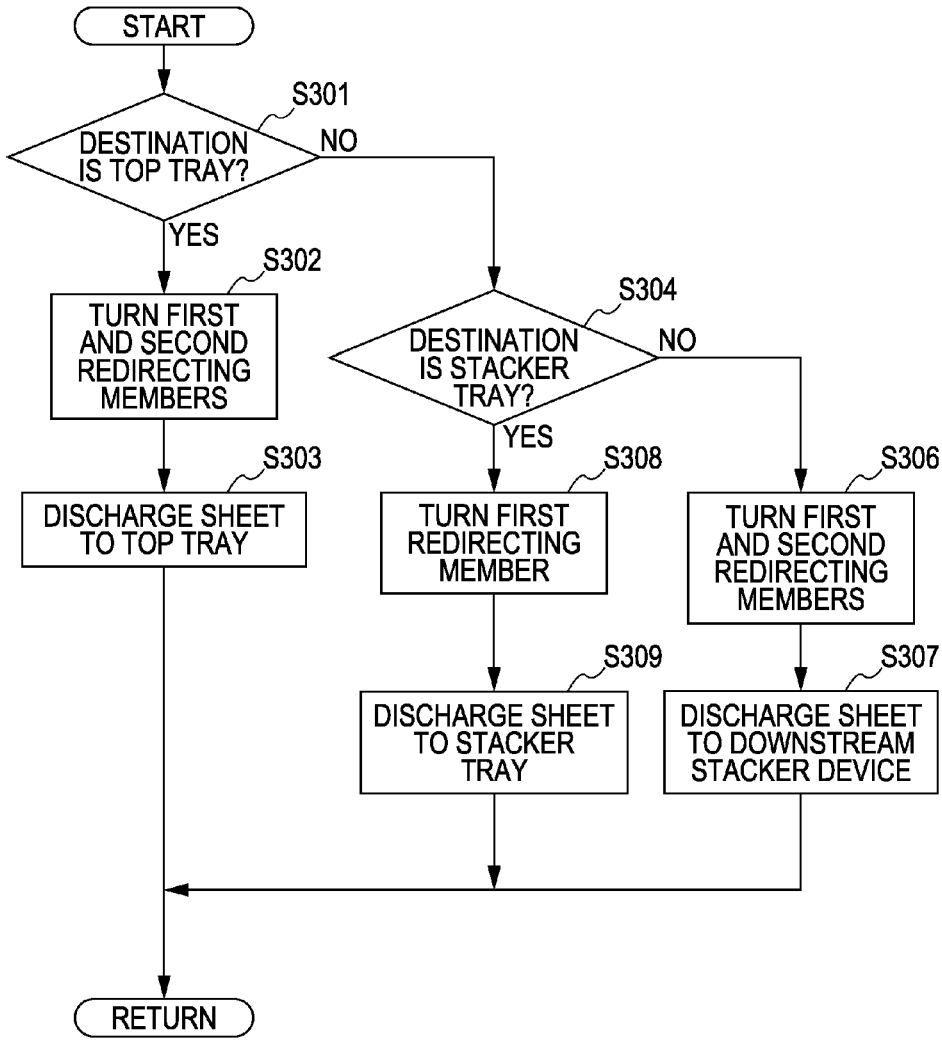
FIG. 4 is a flowchart for describing a sheet stacking operation of the stacker.

The sheet stacking operation performed by the stacker 100 having the above-described configuration will be described with reference to a flowchart shown in FIG. 4.

After a sheet is discharged from the body 901 of the image forming apparatus 900, the sheet is conveyed into the stacker 100 by a pair of entrance rollers 101 of the stacker 100 to the first redirecting member 103. Prior to sheet conveyance, the stacker control section 210 receives sheet information, such as the sheet size, the sheet type, and the sheet discharge destination, from the controller 960 (the CPU circuit section 206) provided in the body 901 of the image forming apparatus 900.

Then, the stacker control section 210 checks whether or not the sheet discharge destination indicated by the information sent from the controller 960 is the top tray 106 (step S301). If the sheet discharge destination is the top tray 106 (YES in step S301), the stacker control section 210 turns the first redirecting member 103 and the second redirecting member 108 to respective positions shown in broken lines in FIG. 3 (step S302). Accordingly, the sheet is guided through the pair of entrance rollers 101, a conveying roller 107, and pairs of conveying rollers 104. Subsequently, the sheet is discharged by a pair of discharge rollers 105 to the top tray 106 (step S303) and is stacked thereon.

If the sheet discharge destination is not the top tray 106 (NO in step S301), the stacker control section 210 further checks whether or not the sheet discharge destination is either of the first and second stacker trays 112*a* and 112*b* (step S304). If it is determined that the sheet discharge destination is neither of the first and second stacker trays 112*a* and 112*b* (NO in step S304), more specifically, if it is determined that the sheet discharge destination is a stacker device (not shown) provided on the downstream side of the stacker 100, the first redirecting member 103 is turned to the position shown in broken lines (step S306).

Further, the second redirecting member 108 is turned to the position shown in solid lines in FIG. 3 (step S306). As a result, the sheet that has been conveyed by the pair of entrance rollers 101 is further conveyed through the conveying roller 107 and pairs of conveying rollers 102 to a pair of exit rollers 109, and is passed to the stacker device (not shown) on the downstream side (step S307).

If the sheet discharge destination is either of the first and second stacker trays 112*a* and 112*b* (YES in step S304), the first redirecting member 103 is turned to the position shown in solid lines (step S308). As a result, the sheet is guided by the first redirecting member 103, is conveyed to the pair of conveying rollers 110A, is discharged by the discharge belt 114, serving as a part of the pair of discharging rotary members 122A, to either of the first and second stacker trays 112*a* and 112*b*, and is stacked thereon (step S309).

In this embodiment, as described above, sheets of small size such as A4 are stacked onto either of the first and second stacker trays 112*a* and 112*b*.

Figure 5:
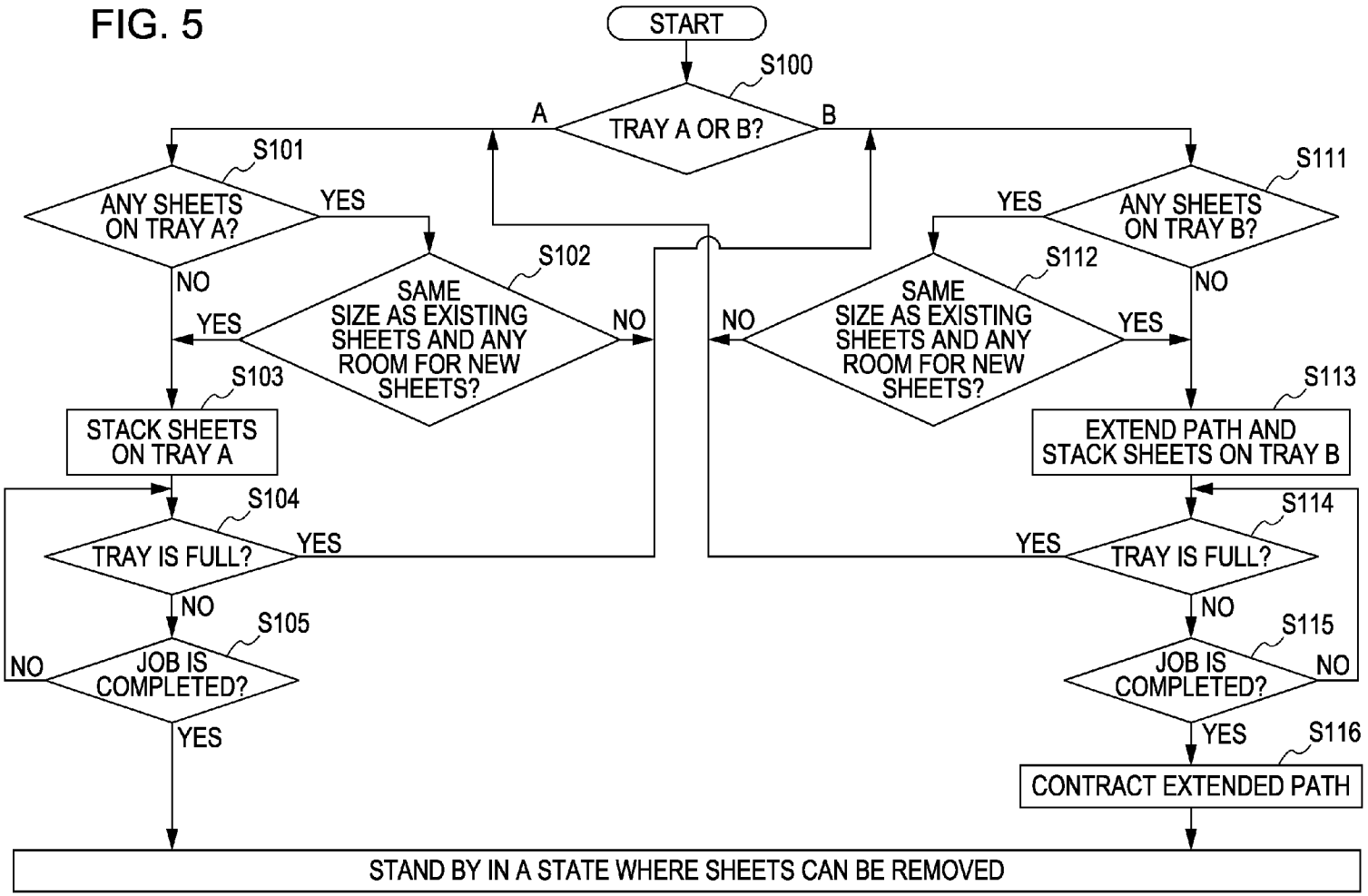
FIG. 5 is a flowchart for describing an operation of stacking small-sized sheets onto one of first and second stacker trays included in the stacker.

FIG. 5 shows a flowchart of an operation in a case where small-sized sheets are stacked onto the first or second stacker tray 112*a* or 112*b*. In FIG. 5, the first stacker tray 112*a* and the second stacker tray 112*b* are simply denoted as a tray A and a tray B, respectively.

When a small-sized sheet is conveyed to the stacker 100, the stacker control section 210 determines whether to stack the sheet onto the tray A or the tray B (step S100). If it is determined to stack the sheet onto the tray A (A in step S100), the stacker control section 210 first checks whether or not there are any sheets on the tray A (step S101). If there are no sheets on the tray A (NO in step S101), the sheet is stacked onto the tray A (step S103).

If there are some sheets in the tray A (YES in step S101), the stacker control section 210 checks whether or not the size of the sheet to be stacked is the same as that of the existing sheets on the tray A and whether or not the tray A still has room for new sheets (step S102). If the size of the sheet to be stacked is the same as that of the existing sheets on the tray A and if the tray A still has room for new sheets (YES in step S102), the sheet is stacked onto the tray A (step S103). If the tray A has no room for new sheets or if the size of the sheet to be stacked is not the same as that of the existing sheets on the tray A (NO in step S102), the stacker control section 210 checks whether or not the sheet can be stacked onto the tray B. This case will be described below.

This operation of stacking sheets onto the tray A is continued until the tray A becomes full of sheets. If the tray A becomes full (YES in step S104), the subsequent sheet is to be stacked onto the other tray, the tray B. Even if the tray A is not yet full (NO in step S104), the job may be completed. In such a case (YES in step S105), the stacker 100 temporarily stops in a state where the stacked sheets can be removed. Removal of sheets when the tray becomes full will be described separately below.

If the tray A becomes full (YES in step S104) and therefore the subsequent sheet is to be stacked onto the tray B, the stacker control section 210 first checks whether or not there are any sheets on the tray B (step S111). If there are no sheets on the tray B (NO in step S111), the reel film 123 is drawn out first, as described above, so as to extend the sheet conveying path, and the subsequent sheet is then stacked onto the tray B (step S113). This sequence is also performed when the stacker control section 210 determines to stack the sheet onto the tray B at the beginning (B in step S100).

If there are some sheets on the tray B (YES in step S111), the stacker control section 210 checks whether or not the size of the sheet to be stacked is the same as that of the existing sheets on the tray B and whether or not the tray B still has room for new sheets (step S112). If the size of the sheet to be stacked is the same as that of the existing sheets on the tray B and if the tray B still has room for new sheets (YES in step S112), the sheet conveying path is extended first and the sheet is then stacked onto the tray B (step S113).

This operation of stacking sheets onto the tray B is continued until the tray B becomes full of sheets. If the tray B becomes full (YES in step S114), the subsequent sheet is to be stacked on the other tray, the tray A. Even if the tray B is not yet full (NO in step S114), the job may be completed. In such a case (YES in step S115), the extended path is first drawn in (step S116) and then the stacker 100 temporarily stops in a state where the stacked sheets can be removed. Removal of sheets when the tray becomes full will be described separately below.

According to FIG. 5, sheets are stacked onto the tray A and the tray B in that order. However, the order of the trays selected in stacking sheets is arbitrary. For example, in a case where sheets are stacked onto the tray B first and then onto the tray A, the same advantageous effect as described above can be obtained.

Figure 6A:
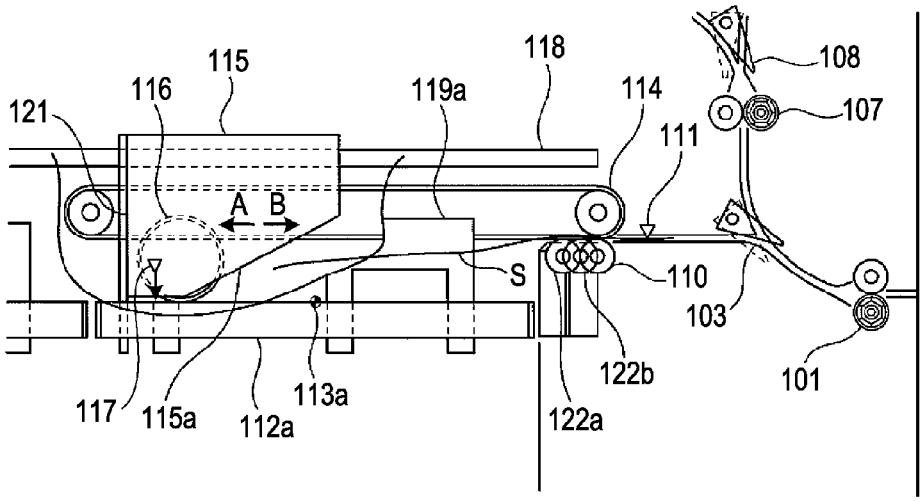
FIGS. 6A and 6B each illustrate an operation performed in the stacker in which a sheet is stacked onto the first stacker tray positioned on the upstream side in a sheet discharging direction.

Now, an operation of the stacker 100 in a case where sheets are stacked onto the first stacker tray 112*a* positioned on the upstream side in the sheet discharging direction will be described. This operation is performed in step S103 in the flowchart shown in FIG. 5. In this operation, the stacker control section 210 first causes the sheet guiding unit 115 to move to a predetermined sheet stacking position above the first stacker tray 112*a*, as shown in FIG. 6A, in accordance with the sheet size information contained in the sheet information sent to the stacker control section 210 beforehand. In this state, the stacker 100 is ready for sheet stacking.

Next, a sheet S that has been discharged from the body 901 of the image forming apparatus 900 is conveyed through the pair of entrance rollers 101, the pair of conveying rollers 110A, and the pair of discharging rotary members 122A and is brought into contact with the tapered portion 115*a* of the sheet guiding unit 115. With the guide of the tapered portion 115*a* toward the first stacker tray 112*a*, the leading end of the sheet S is led to the knurled belt 116.

On the other hand, when the timing sensor 111 disposed on the upstream side with respect to the discharge belt 114 detects the passage of the leading end of the sheet S, the rotating speed of the discharge belt 114 is reduced, in response to the detection, before the trailing end of the sheet S is released from the discharge belt 114. In this manner, the sheet S can be conveyed stably to the knurled belt 116. The sheet discharging speed produced at this time is substantially the same as the conveying speed produced by the knurled belt 116.

Figure 6B:
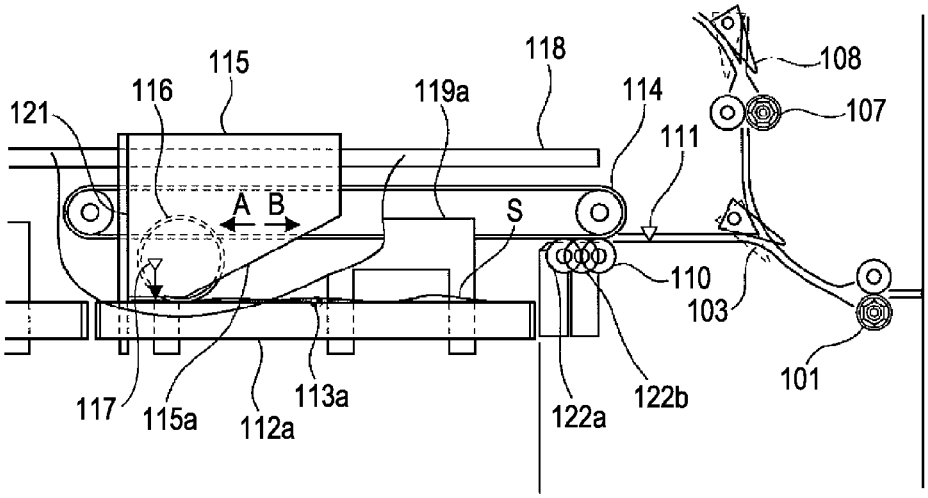

Subsequently, referring to FIG. 6B, the sheet S is assuredly made to knock against the leading end stopper 121 with the aid of the knurled belt 116, whereby tilting of the sheet S is corrected. Then, widthwise displacement (displacement in lateral registration) of the sheet S is corrected with a jogging motion of an aligning plate 119*a* in the sheet width direction. Thus, the sheet S is stacked onto the first stacker tray 112*a* with high alignment accuracy. The rotating speed of the discharge belt 114 that has been reduced is increased after the sheet S is discharged therefrom, so that the same conveying speed as that produced by the pair of entrance rollers 101 is regained before a subsequent sheet is conveyed to the discharge belt 114.

By repeating such a sheet stacking sequence, sheets S are sequentially stacked onto the first stacker tray 112*a* with high alignment accuracy. During the sheet stacking sequence, the sheet surface detection sensor 117 continuously monitors the top surface of the stack of sheets. When the interval between the sheet guiding unit 115 and the top surface of the stack of sheets becomes smaller than the predetermined interval, the first-stacker-tray elevation motor 129*a* (see FIG. 2) is controlled to lower the first stacker tray 112*a* by a predetermined length so that a constant interval is maintained between the sheet guiding unit 115 and the top surface of the stack of sheets. Thus, a force of the knurled belt 116 with which each sheet is guided is maintained at a constant level and sheet stacking with improved accuracy can be realized.

Detection of the state where the first stacker tray 112*a* is full of sheets is usually performed on the basis of the number of sheets that have been discharged from the pair of discharging rotary members 122A or by using a detector or the like that detects the height of the stack of sheets on the first stacker tray 112*a*. When the first stacker tray 112*a* becomes full of sheets, the first stacker tray 112*a* is automatically lowered to and secured on a dolly 120 shown in FIG. 3. In this state, the sheets are ready to be carried outside. An operation of carrying sheets with the dolly 120 will be described separately below.

Now, an operation of the stacker 100 in a case where sheets are stacked onto the second stacker tray 112*b* positioned on the downstream side in the sheet discharging direction will be described. This operation is performed in step S113 of the flowchart shown in FIG. 5. In this embodiment, sheets are stacked onto the second stacker tray 112*b* if, for example, the first stacker tray 112*a* has no room for new sheets or if the size of sheets to be newly stacked is not the same size as that of the existing sheets on the first stacker tray 112*a*.

If the first stacker tray 112*a* has no room for new sheets or if the size of sheets to be newly stacked is not the same size as that of the existing sheets on the first stacker tray 112*a*, the stacker control section 210 starts controlling the operation of stacking sheets onto the second stacker tray 112*b*.

Figure 7:
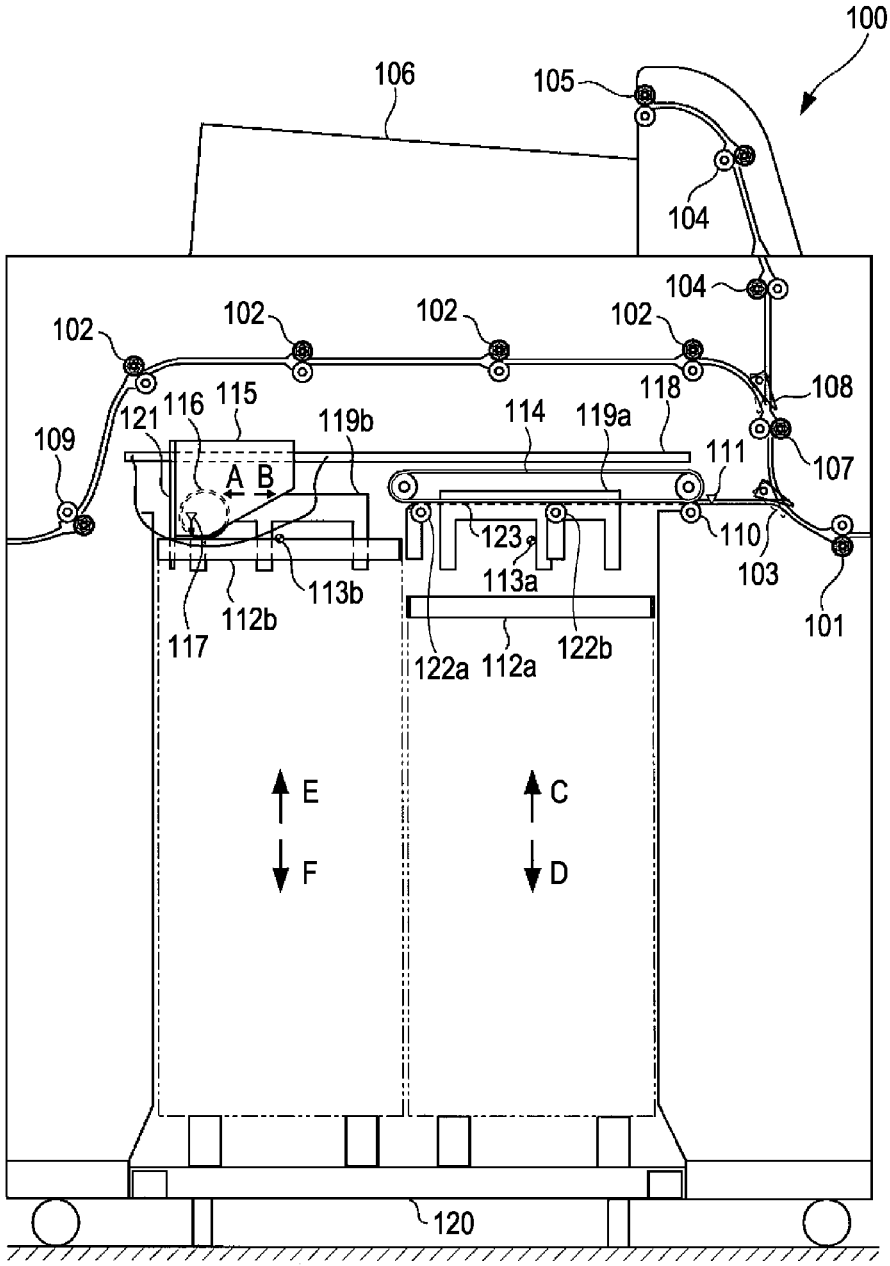
FIG. 7 illustrates an operation performed in the stacker in which a sheet is stacked onto the second stacker tray positioned on the downstream side in the sheet discharging direction.
Figure 8A:
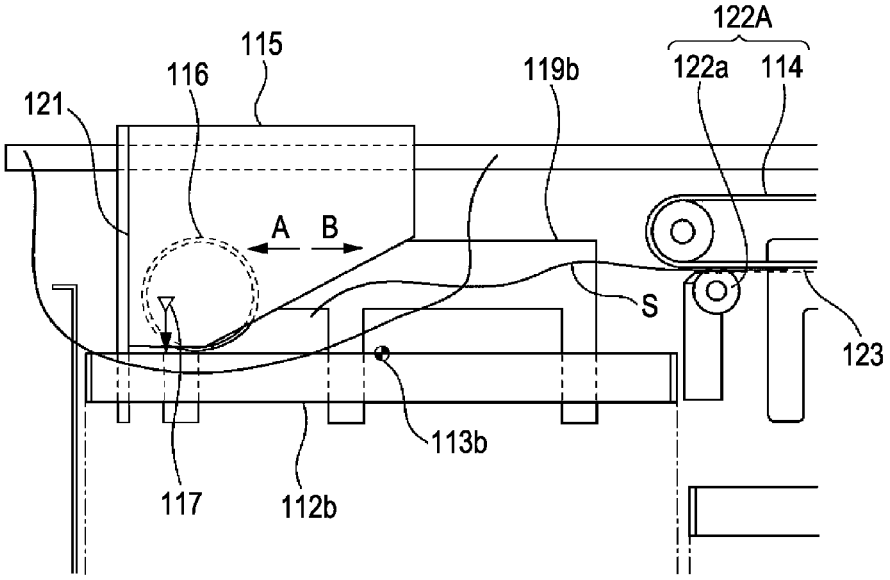
FIGS. 8A and 8B each illustrate the operation performed in the stacker in which a sheet is stacked onto the second stacker tray positioned on the downstream side in the sheet discharging direction.

First, referring to FIG. 7, the first and second stacker trays 112*a* and 112*b* are lowered by the first-stacker-tray elevation motor 129*a* and the second-stacker-tray elevation motor 129*b*, respectively, to positions at which the first and second stacker trays 112*a* and 112*b* allow the sheet guiding unit 115 to move. Then, the sheet guiding unit 115 is moved by a drive unit (not shown) in the arrow-A direction and is stopped at a sheet stacking position above the second stacker tray 112*b*. Subsequently, the second stacker tray 112*b* is raised to a position at which the home position detection sensor 113*b* can detect the second stacker tray 112*b*.

Next, the extension rollers 122*a* and 122*b* are moved leftward in FIG. 7 by a drive unit (not shown) while the reel film 123 is drawn out of a case (not shown), whereby the sheet conveying path is extended. The sheet conveying path is extended so as to reach a position at which each sheet can be stably discharged onto the second stacker tray 112*b*, i.e., a position at which substantially the same positional relationship is established between the extension roller 122*a* and the first stacker tray 112*a* and between the extension roller 122*a* and the second stacker tray 112*b*. When the above-described sequence is completed and the state shown in FIG. 7 is established, the stacker 100 is ready for sheet stacking onto the second stacker tray 112*b*.

Then, a sheet S that has been discharged from the body 901 of the image forming apparatus 900 is conveyed through the pair of entrance rollers 101 and the pair of conveying rollers 110A, and is further conveyed by the pair of discharging rotary members 122A over the reel film 123 that have been drawn out. Subsequently, referring to FIG. 8A, the sheet S is conveyed toward the sheet guiding unit 115 and is guided by the sheet guiding unit 115 toward the second stacker tray 112*b*.

On the other hand, when the passage of the leading end of the sheet S is detected by the timing sensor 111, the rotating speed of the discharge belt 114 is reduced, in response to the detection, before the trailing end of the sheet S is released from the extension roller 122*a*. Thus, the sheet S can be stably conveyed to the knurled belt 116.

Figure 8B:
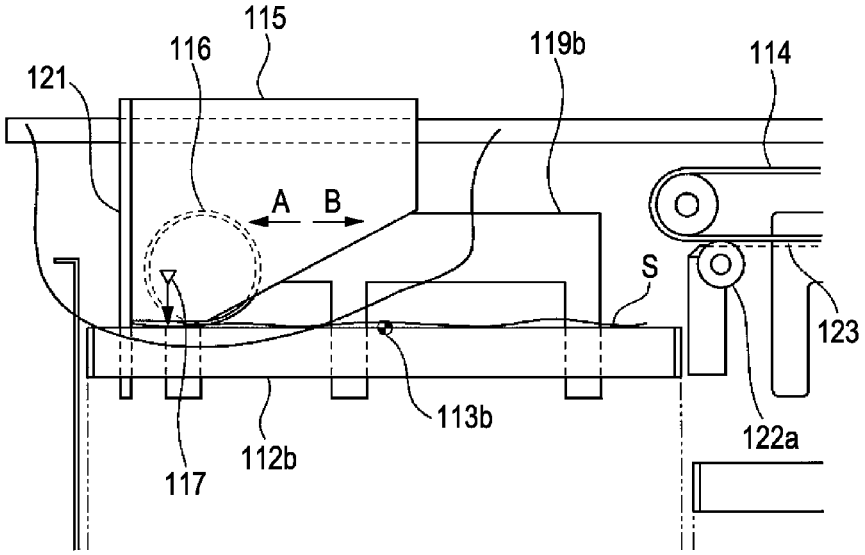

Next, referring to FIG. 8B, the sheet S is assuredly made to knock against the leading end stopper 121 with the aid of the knurled belt 116, whereby tilting of the sheet S is corrected.

Then, displacement in lateral registration of the sheet S is corrected with a jogging motion of an aligning plate 119*b* in the sheet width direction. Thus, the sheet S is stacked onto the second stacker tray 112*b* with high alignment accuracy. The rotating speed of the discharge belt 114 that has been reduced is increased after the sheet S is discharged therefrom, so that the same conveying speed as that produced by the pair of entrance rollers 101 is regained before a subsequent sheet is conveyed to the discharge belt 114.

By repeating such a sheet stacking sequence, sheets S are sequentially stacked onto the second stacker tray 112*b* with high alignment accuracy. During the sheet stacking sequence, the sheet surface detection sensor 117 continuously monitors the top surface of the stack of sheets. When the interval between the sheet guiding unit 115 and the top surface of the stack of sheets becomes smaller than the predetermined interval, the second-stacker-tray elevation motor 129*b* (see FIG. 2) is controlled to lower the second stacker tray 112*b* by a predetermined length so that a constant interval is maintained between the sheet guiding unit 115 and the top surface of the stack of sheets. Thus, a force of the knurled belt 116 with which a sheet is guided is maintained at a constant level and sheet stacking with improved accuracy can be realized.

Detection of the state where the second stacker tray 112*b* is full of sheets S is usually performed on the basis of the number of sheets S that have been discharged from the pair of discharging rotary members 122A or by using a detector or the like that detects the height of the stack of sheets on the second stacker tray 112*b*. When the second stacker tray 112*b* is full of sheets S, the second stacker tray 112*b* is automatically lowered to and secured on the dolly 120. In this state, the sheets are ready to be carried outside.

Figure 9A:
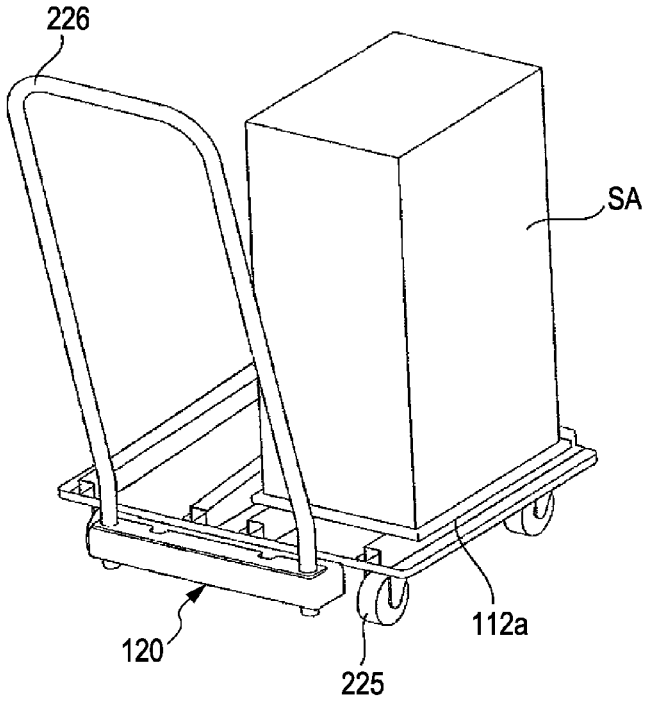
FIGS. 9A and 9B each show a state where the first or second stacker tray that has been lowered with a full stack of sheets is placed on a dolly together with the stack of sheets.
Figure 9B:
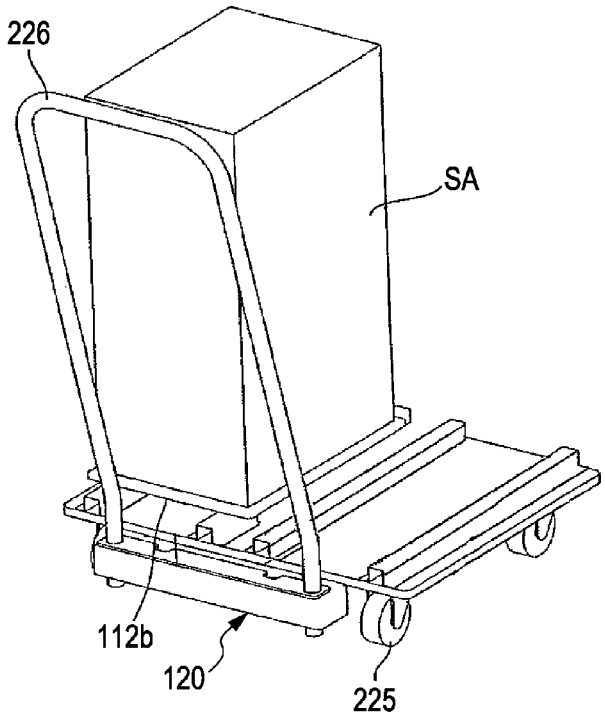

FIGS. 9A and 9B each show a state where the first or second stacker tray 112*a* or 112B that has been lowered with full of sheets is placed on the dolly 120 together with the sheets stacked thereon. FIG. 9A shows a state where the first stacker tray 112*a* that has been lowered with a full sheet stack SA thereon is placed on the dolly 120 together with the sheet stack SA. FIG. 9B shows a state where the second stacker tray 112*b* that has been lowered with a full sheet stack SA thereon is placed on the dolly 120 together with the sheet stack SA.

The first and second stacker trays 112*a* and 112*b* are supported by respective supporting members (not shown) that can be raised and lowered. The first and second stacker trays 112*a* and 112*b* are passed onto the dolly 120 when the supporting members, which will be described separately below, are lowered to a position below a supporting surface of the dolly 120.

The dolly 120 has casters 225 and a handle 226 so that the first or second stacker tray 112*a* or 112*b* carrying fully stacked sheets thereon can be carried outside the stacker 100. By moving the dolly 120 while holding the handle 226, a large sheet stack SA can be easily carried at a time together with the first or second stacker tray 112*a* or 112*b*.

After the first or second stacker tray 112*a* or 112*b* is passed onto the dolly 120 in the aforementioned manner, the first or second stacker tray 112*a* or 112*b* is secured to the dolly 120 with a securing member (not shown) such as a pin provided on the top surface of the dolly 120. Then, the dolly 120 carrying a large sheet stack SA thereon is pulled out of the stacker 100. In this manner, the sheet stack SA on the first or second stacker tray 112*a* or 112*b* placed on the dolly 120 is removed.

After the dolly 120 is pulled out as described above and the sheet stack SA is removed, the dolly 120 and the first or second stacker tray 112*a* or 112*b* are set to the stacker 100 again.

When the dolly 120 is set to the stacker 100, a dolly set sensor (not shown) detects this setting. In accordance with a detection signal generated in response to this detection, the stacker control section 210 causes the first or second stacker tray 112*a* or 112*b* to be raised. In this manner, the first or second stacker tray 112*a* or 112*b* is put back to the state shown in FIG. 3 described above, enabling new sheets to be stacked thereon.

Figure 10:
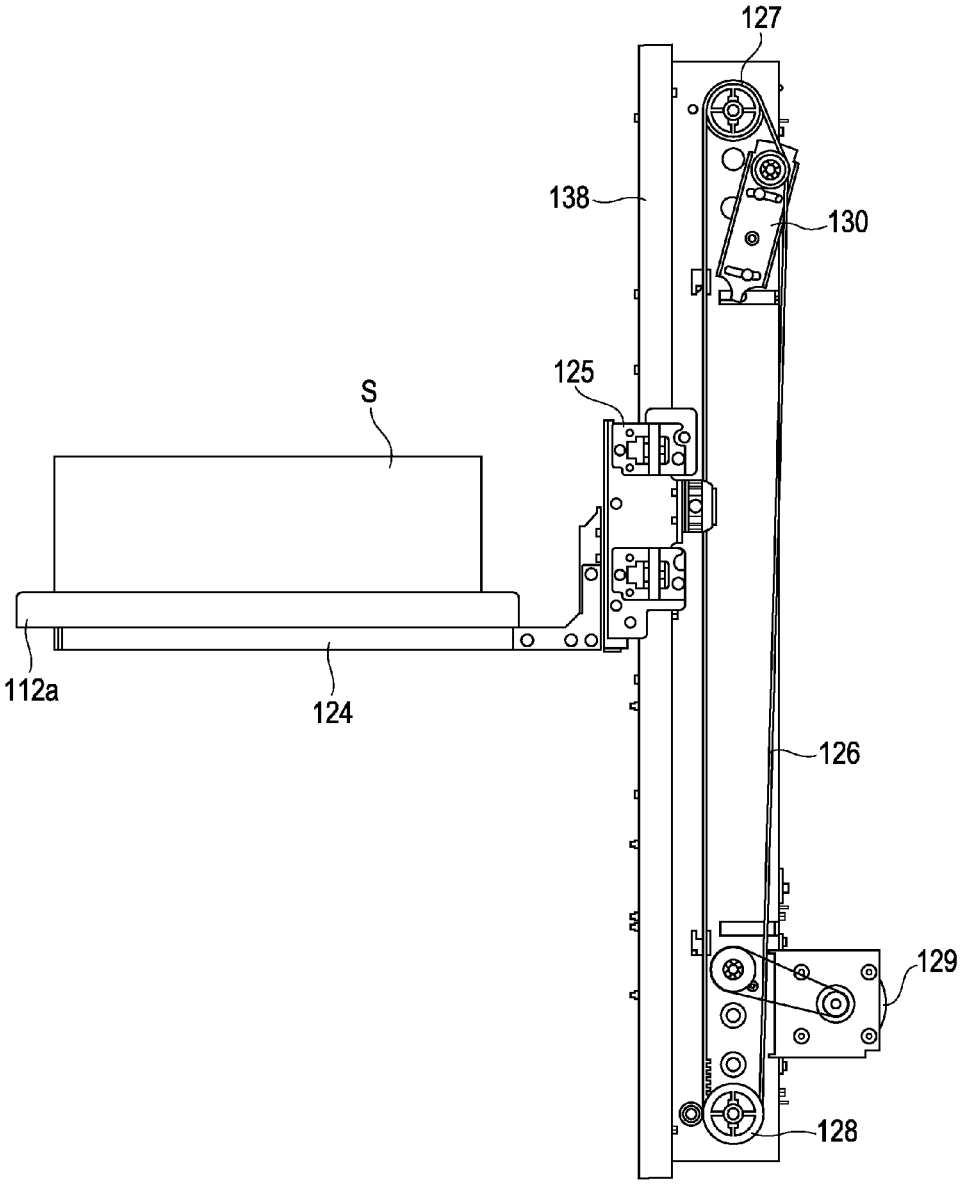
FIG. 10 is a side view of a stacker elevation drive unit of the stacker.

FIG. 10 is a side view of a stacker elevation drive section that raises and lowers the first stacker tray 112*a*. Referring to FIG. 10, the stacker elevation drive section includes, on both sides thereof, rail members 138, elevation units 125 movably attached to the respective rail members 138, and arms 124 attached to the respective elevation units 125 and holding the first stacker tray 112*a*. Usually, two arms 124 are provided per stacker tray. Another stacker elevation drive section that raises and lowers the second stacker tray 112*b* also has the same configuration.

In each of the stacker elevation drive section, the elevation units 125 raises and lowers the corresponding one of the first and second stacker trays 112*a* and 112*b*. The elevation units 125 are affixed to drive belts 126, respectively. The drive belts 126 are each stretched between drive pulleys 127 and 128. The drive pulleys 128, the lower ones, are driven by the elevation motor 129 with the aid of a gear unit described below referring to FIG. 11. Referring to FIG. 10, tensioners 130 provide the respective drive belts 126 with a predetermined tension.

Figure 11:
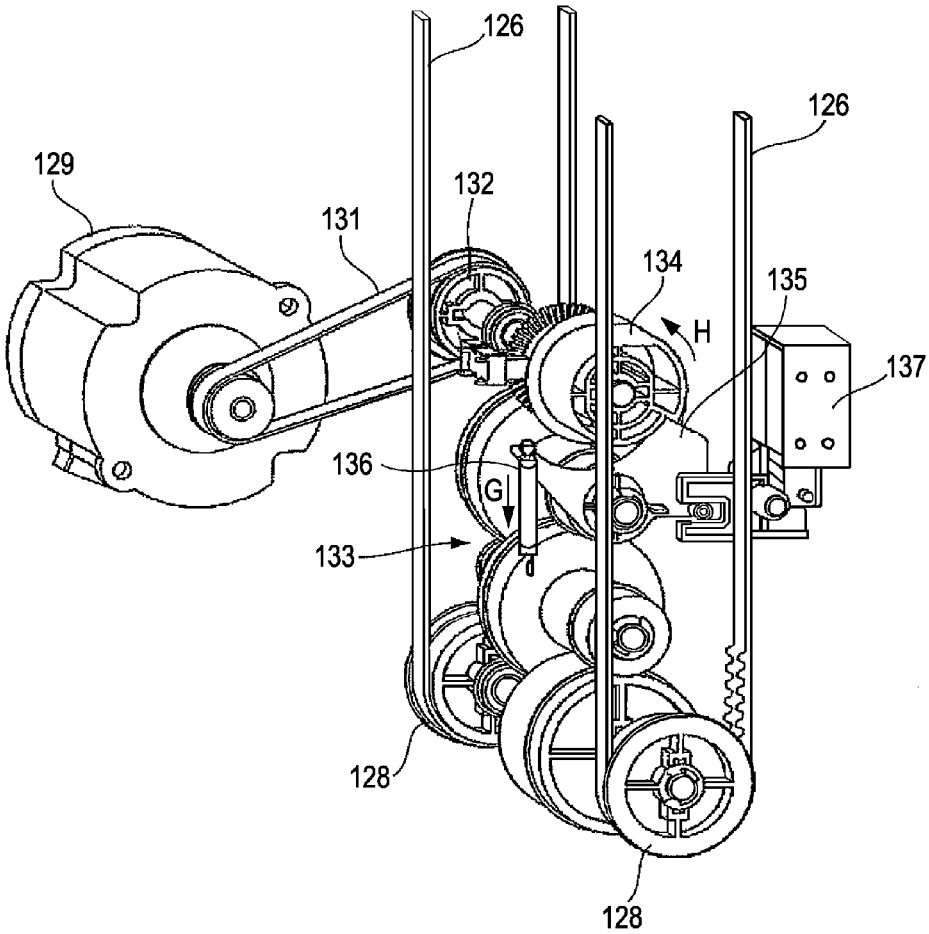
FIG. 11 is a perspective view of a gear unit of the stacker elevation drive unit.

FIG. 11 is a perspective view of the gear unit. A driving force of the elevation motor 129 is transmitted to the drive pulleys 128 sequentially through a drive belt 131, a drive pulley 132, and a series of gears 133. The original driving speed produced by the elevation motor 129 is reduced by the series of gears 133 while the driving torque is increased.

Since the force required to move the stacker tray is large, the stacker elevation drive section usually includes two elevation units 125, which are driven as shown in FIG. 11, provided on two respective sides of the stacker elevation drive section. In addition, the drive detection sensor 232 (see FIG. 2) is provided at a halfway point along the series of gears 133.

In this embodiment, a ratchet wheel 134 and a pawl 135 regulating the rotating direction of the ratchet wheel 134 are provided at positions along the series of gears 133. The pawl 135 locks the ratchet wheel 134 by being pulled by a tension spring 136 in an arrow-G direction, whereby the ratchet wheel 134 is normally regulated to rotate only in an arrow-H direction shown in FIG. 11, i.e., a direction in which the elevation units 125 are caused to be lowered.

When the solenoid 137 is driven, the pawl 135 is moved while extending the tension spring 136 in a direction opposite to the arrow-G direction. With this driving of the solenoid 137, the pawl 135 turns in such a manner as to move away from the ratchet wheel 134. Thus, the ratchet wheel 134 is allowed to rotate in a direction in which the elevation units 125 are caused to be raised.

The solenoid 137 is turned on or off by a front door microswitch 150, which will be described separately below, that is turned on or off in accordance with the closed or open state of a front door 100B (see FIG. 1). Specifically, in a state where the front door 100B is closed, the solenoid 137 is on with a driving current supplied via the front door microswitch 150, the front door 100B being provided on the body 100A of the stacker 100 and being opened in removing sheets on the first or second stacker tray 112*a* or 112*b*. In contrast, in a state where the front door 100B is open, the solenoid 137 is off without the driving current supplied via the front door microswitch 150.

With such a configuration in which no current is supplied to the solenoid 137 in the state where the front door 100B is open, the elevation units 125 can only move downward in the state where the front door 100B is open.

In short, in this embodiment, the driving force of the elevation motor 129 can be transmitted to the elevation units 125 in a selectable direction through a transmission unit including the ratchet wheel 134, the pawl 135, the solenoid 137, the tension spring 136, and the front door microswitch 150. In the state where the front door 100B is open, the transmission unit transmits the driving force of the elevation motor 129, which is a drive source that drives the elevation units 125, to the elevation units 125 in a direction selected as described above, whereby regulating the upward movement of the corresponding one of the stacker trays 112*a* and 112*b*.

Figure 12:
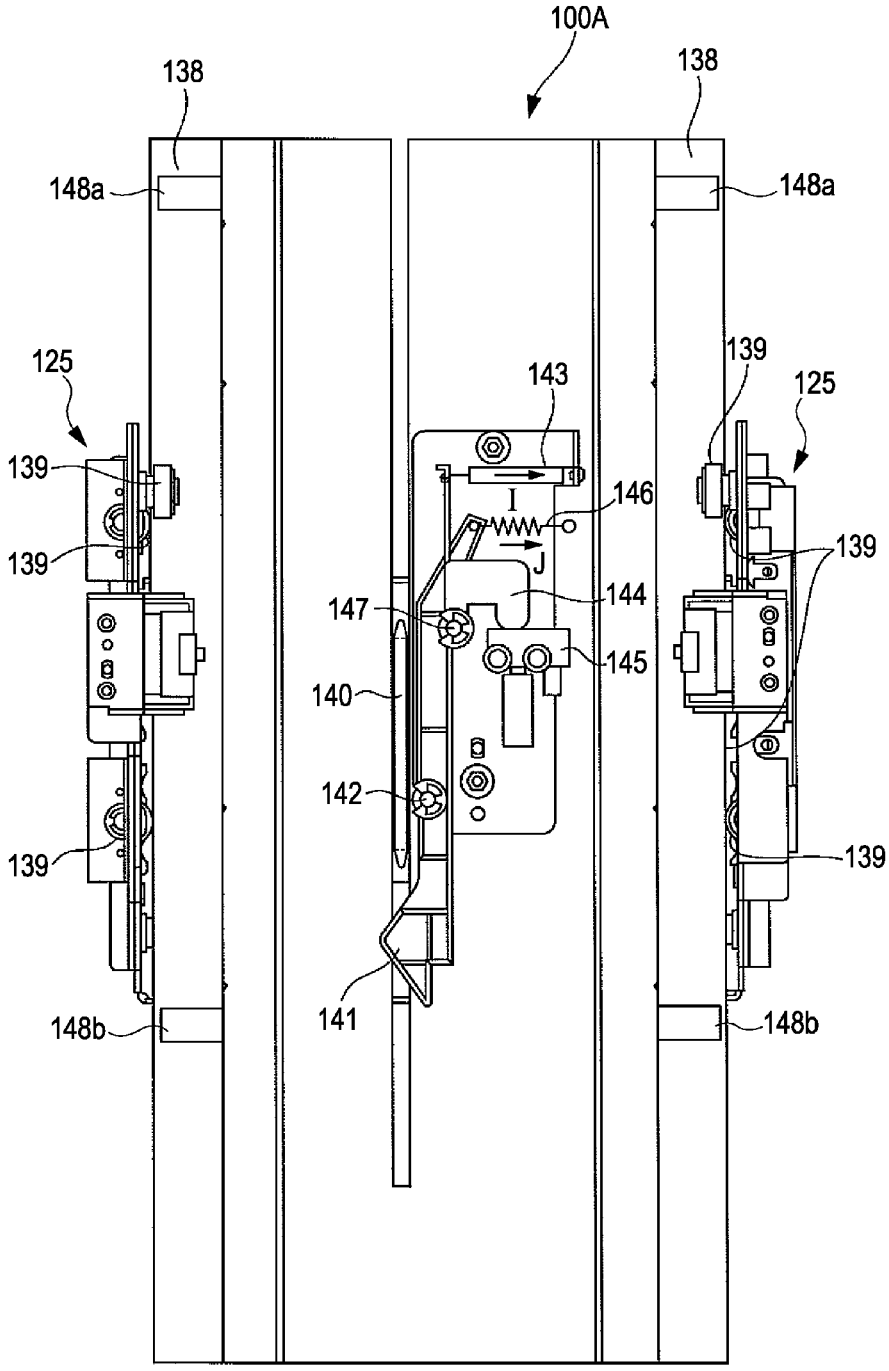
FIG. 12 is a rear view of the stacker elevation drive unit.

FIG. 12 is a rear view of one of the stacker elevation drive sections. Referring to FIG. 12, the elevation units 125 are held by the respective rail members 138 with a plurality of bearings 139 provided on the elevation units 125, in such a manner that the elevation units 125 are movable upward and downward. The elevation units 125 are provided with a lever 140.

In this embodiment, when the front door 100B is opened so as to pull out the dolly 120 because one of the stacker trays, the first stacker tray 112*a* for example, has become full, sheets can still be stacked onto the other stacker tray 112*b*. Since sheets can still be stacked onto the other stacker tray 112*b* when the dolly 120 is pulled out, sheets can be discharged continuously without interruption of the image forming operation.

In this case, however, when the dolly 120 is set to the stacker 100 after the sheets fully stacked on the one stacker tray 112*a* are removed, there is a possibility of interference between the dolly 120 and the other stacker tray 112*b* that is being lowered gradually while continuously receiving sheets. In another case, something may be accidentally placed under the other stacker tray 112*b* that is being lowered, leading to damage.

Therefore, in this embodiment, when the other stacker tray 112*b* reaches a predetermined area (a regulated area), the downward movement of the other stacker tray 112*b* is stopped. Specifically, referring to FIG. 12, each of the stacker elevation drive sections includes an entrance detection lever 141 provided to the body 100A of the stacker 100. The entrance detection lever 141 for the other stacker tray 112*b* detects the corresponding elevation units 125 entering the predetermined area (the regulated area), whereby the movement of the other stacker tray 112*b* is stopped if the elevation units 125 that are being lowered cause the lever 140 to be detected by the entrance detection lever 141.

A detection mechanism including the entrance detection lever 141 will be described. For each of the stacker elevation drive sections, a microswitch 145 that causes the elevation motor 129 to be driven and a microswitch lever 144 that presses a switch of the microswitch 145 are provided to the body 100A of the stacker 100.

The entrance detection lever 141 is swingably held by the body 100A with a swing shaft 142 while being urged by a tension spring 146 in an arrow-J direction. The microswitch lever 144 is swingably held by the body 100A with a rotating shaft 147 while being urged by a tension spring 143 in an arrow-I direction, thereby maintaining the microswitch 145 to be on. This means that the microswitch 145 is on unless the entrance detection lever 141 is pressed by the lever 140.

Figure 13:
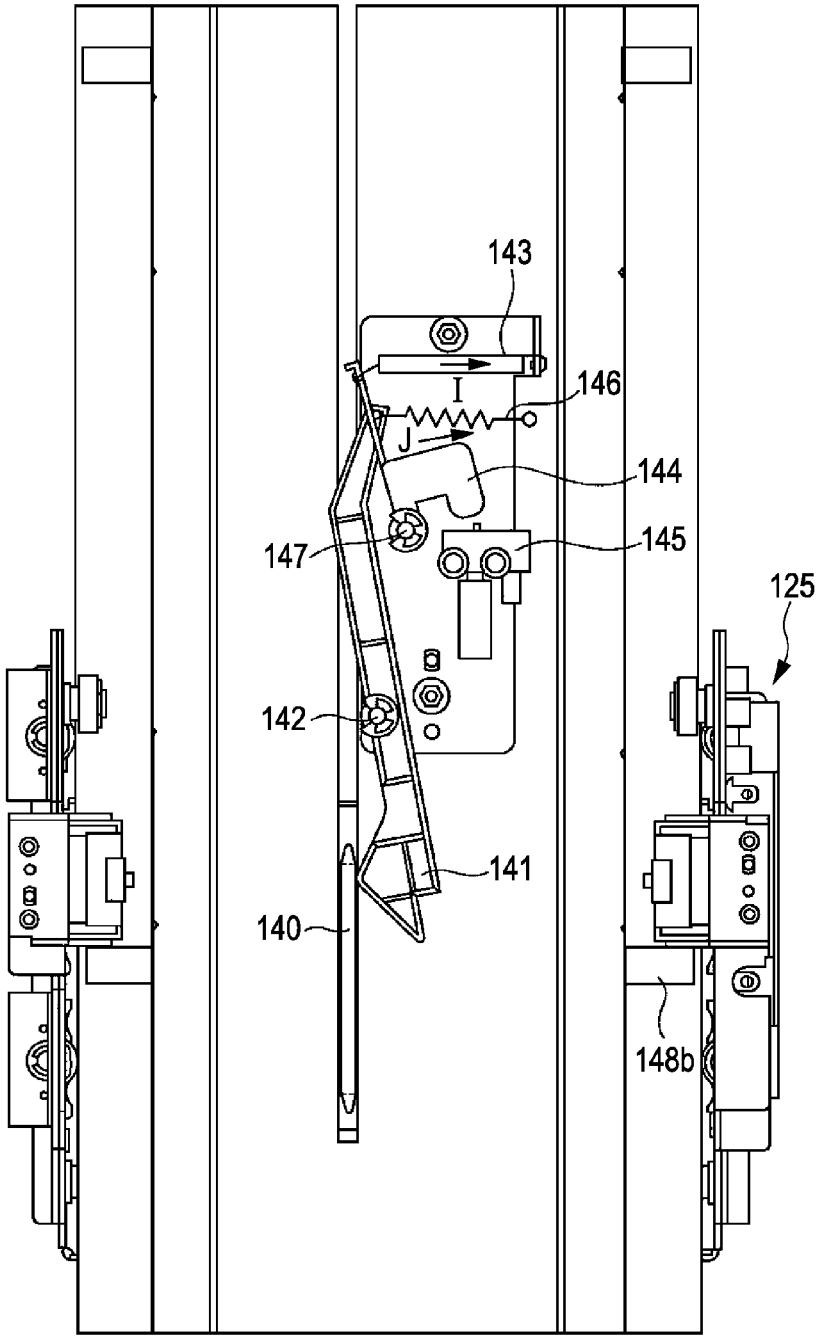
FIG. 13 is a rear view of the stacker elevation drive unit that has been lowered.

FIG. 13 shows a state where the elevation units 125 are lowered from the state shown in FIG. 12. When the elevation units 125 are lowered, the lever 140 provided to the elevation units 125 is also lowered, thereby pressing the entrance detection lever 141.

Accordingly, the entrance detection lever 141 swings counterclockwise with the swing shaft 142 acting as the fulcrum. The entrance detection lever 141 is connected at one end thereof to the microswitch lever 144. Therefore, when the entrance detection lever 141 swings, the microswitch lever 144 also turns counterclockwise.

When the microswitch lever 144 turns as described above, the microswitch 145 serving as a second detecting unit detecting that the corresponding stacker tray, the stacker tray 112*b* in this case, has been lowered to a predetermined position is turned off. In short, if the elevation units 125 are lowered while lowering the stacker tray 112*b* into a predetermined area, the microswitch 145 is turned off and the elevation motor 129 stops. As a result, the elevation units 125 (the stacker tray 112*b*) stop moving.

If the stacker tray 112*b* is lowered into the predetermined area, i.e., lowered beyond a position where the lever 140 presses the entrance detection lever 141, the microswitch 145 is turned off without fail. Even if the microswitch 145 is turned off in such a manner, the elevation motor 129 continues to operate as long as the front door 100B is closed. Therefore, if more sheets are sequentially stacked onto the stacker tray 112*b* in such a state, the stacker tray 112*b* is further lowered. While the foregoing description concerns an exemplary operation of regulating the movement of the stacker tray 112*b* in a case where the stacker tray 112*a* that has become full of sheets is to be removed, the movement of the stacker tray 112*a* in a case where the stacker tray 112*b* that has become full of sheets is to be removed is also regulated in the same manner.

Referring to FIG. 12, the rail members 138 are provided with upper stoppers 148*a*, respectively, that stop the movement of the elevation units 125 by directly having contact therewith so that the stacker 100 is not damaged in a case where the stacker tray 112*a* or 112*b* is accidentally raised beyond a predetermined position. The rail members 138 are also provided with lower stoppers 148*b*, respectively, that stop the movement of the elevation units 125 by directly having contact therewith so that the stacker 100 is not damaged in a case where the stacker tray 112*a* or 112*b* is accidentally lowered beyond a predetermined position.

FIG. 13 shows the state where the elevation units 125 are lowered to the lower limit. In this state, the elevation units 125 are in contact with the respective lower stoppers 148*b* and therefore cannot be lowered any further. It is understood that the microswitch 145 is off in this state. That is, once the elevation units 125 enter the predetermined area, the microswitch 145 is continually off.

Figure 14:
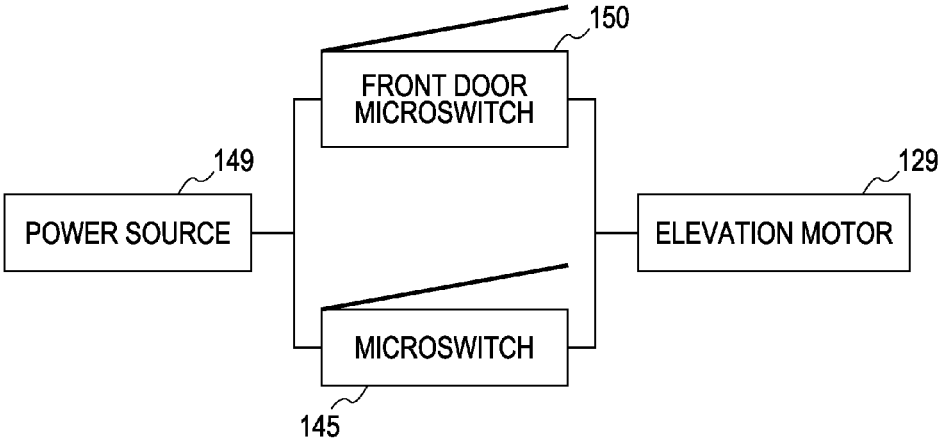
FIG. 14 is a block diagram of a regulating unit provided in the stacker.

Referring to FIG. 14, the microswitch 145 is connected in parallel with the front door microswitch 150 between the elevation motor 129 and a power source 149 supplying a current to the elevation motor 129. The front door microswitch 150 serves as a first detecting unit that detects the front door 100B being opened. The front door microswitch 150 is turned on or off in accordance with the closed or open state of the front door 100B. In the state where the front door 100B is open, the front door microswitch 150 is off. In the state where the front door 100B is closed, the front door microswitch 150 is on.

That is, in the state where the front door 100B is closed, the elevation motor 129 is supplied with a current regardless of the state of the microswitch 145, i.e., regardless of the position of the stacker tray. Therefore, the stacker tray can be raised or lowered freely.

In other words, when the stacker tray is lowered to the topmost position of the predetermined regulated area with an increase of sheets stacked thereon in the state where the front door 100B is open, the microswitch 145 and the front door microswitch 150 cause the elevation motor 129 to stop. In this manner, lowering of the stacker tray is regulated. The microswitch 145 and the front door microswitch 150 constitute a regulating unit that regulates lowering of the stacker tray when the stacker tray resides below the topmost position (a predetermined position) of the regulated area.

Figure 15:
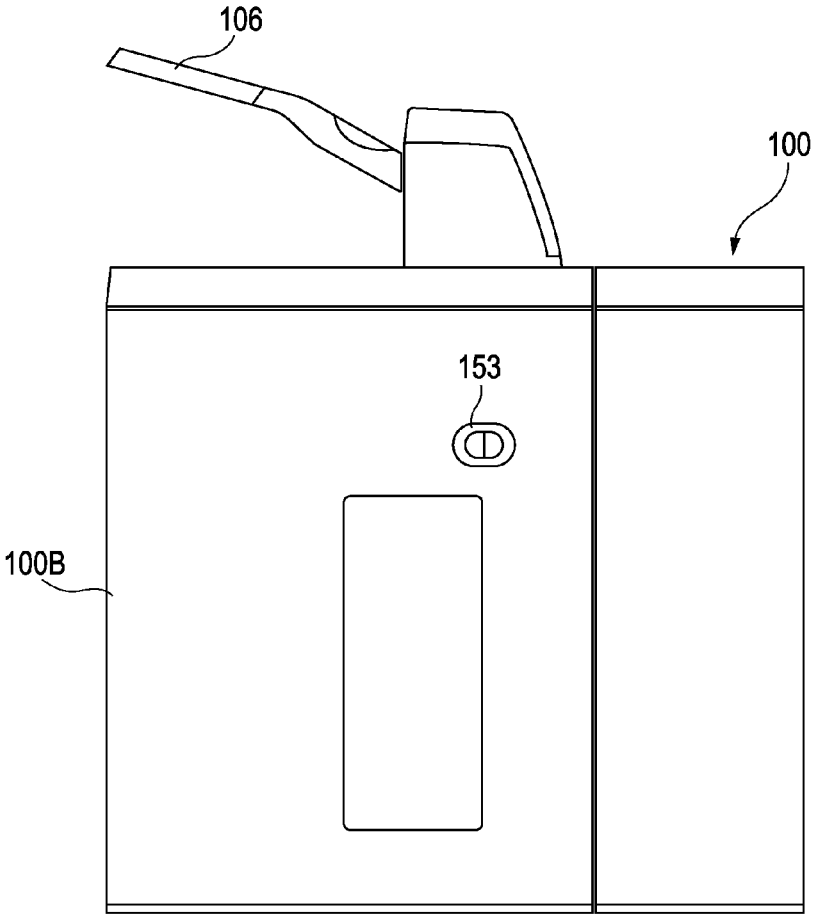
FIG. 15 is a front view of the stacker.

Referring to FIG. 15, the front door 100B has an open switch 153. For example, if one of the stacker trays becomes full of sheets and the sheets need to be removed, the front door 100B can be opened by pressing the open switch 153.

In the state where the front door 100B is open, the front door microswitch 150 is off. Even in this state, however, the other stacker tray can be lowered to a predetermined position as long as the corresponding microswitch 145 is on. Therefore, even if the front door 100B is opened in removing the sheets fully stacked on one of the stacker trays, sheet stacking onto the other stacker tray can be continued as long as the microswitch 145 for the other stacker tray is on.

The microswitch 145 for the other stacker tray is turned off if the other stacker tray that is sequentially receiving sheets is lowered to the topmost position of the predetermined area before the dolly 120 that has been pulled out in removing the fully stacked sheets on the one stacker tray is put back to the stacker 100. Since the elevation motor 129 can only be driven with the microswitch 145 being on in the state where the front door 100B is open, if the microswitch 145 for the other stacker tray is turned off in the aforementioned manner, the other stacker tray is stopped before entering the predetermined regulated area.

With the microswitch 145 and the front door microswitch 150 that control the upward and downward movements and the stoppage of the stacker tray, the elevation units 125 for each of the stacker trays can be freely moved upward and downward within an elevation area as long as the front door 100B is closed.

Figure 16:
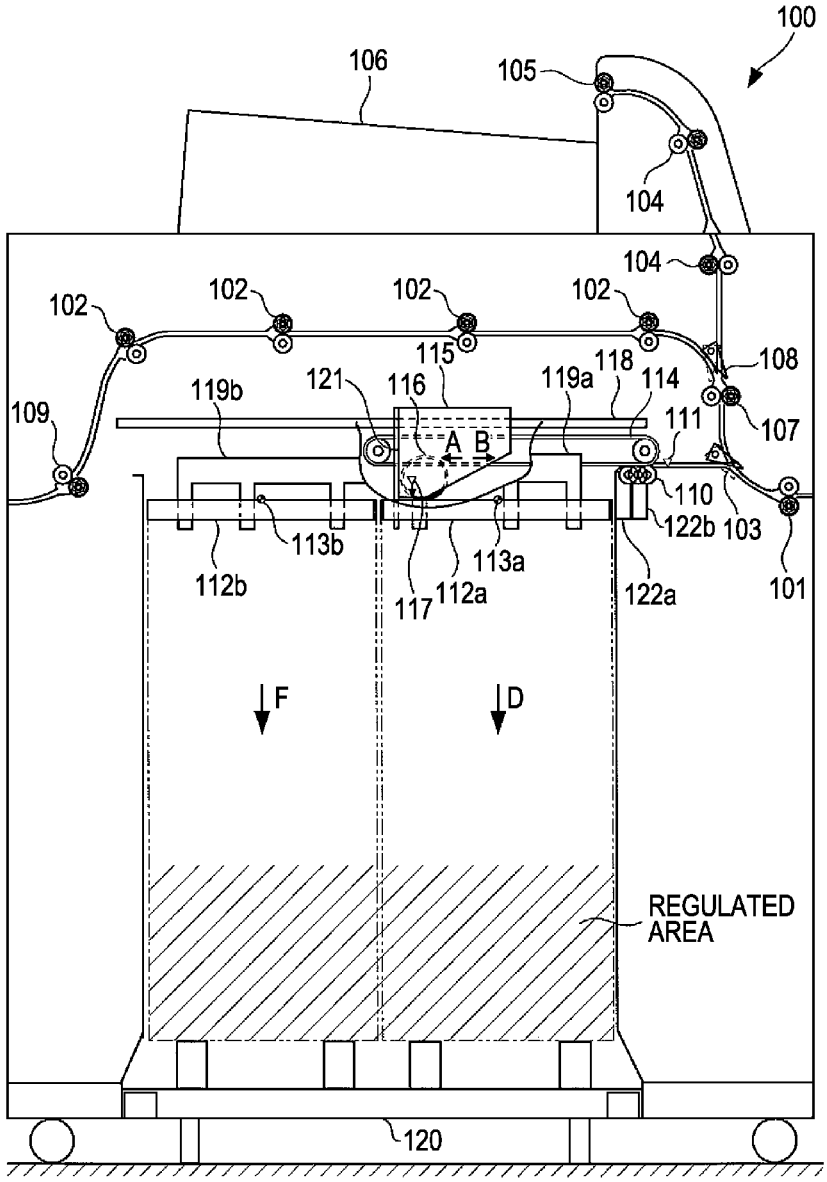
FIG. 16 shows a regulated area determined in the stacker.
Figure 17:
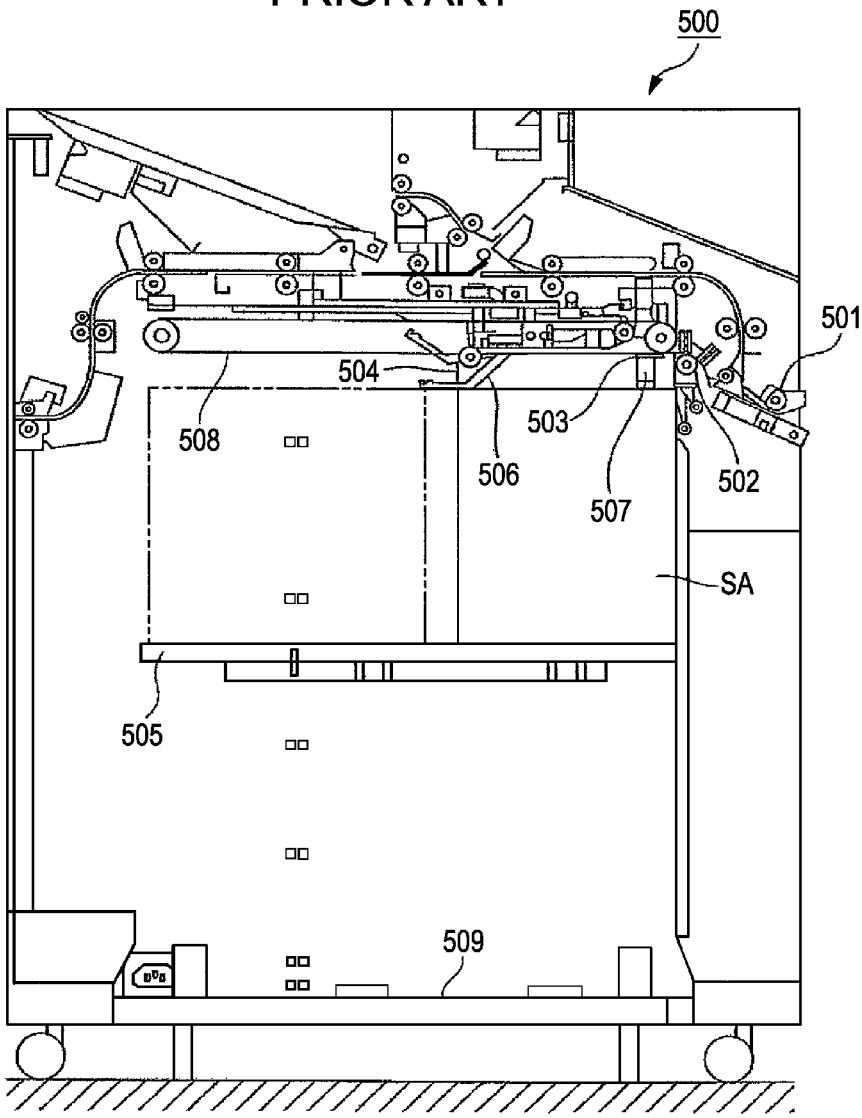
FIG. 17 PRIOR ART
FIG. 17 shows a known large-capacity stacker device.

In contrast, in the state where the front door 100B is open, referring to FIG. 16, the stacker trays 112*a* and 112*b* are regulated to move only downward (arrow-D and -F directions in FIG. 16). If the stacker tray 112*a* or 112*b* is about to enter the predetermined area (regulated area), the corresponding microswitch 145 is turned off and therefore the stacker tray 112*a* or 112*b* stops moving. The height of the regulated area is set in such a manner that a sufficient space is secured as a stackable area, the stacker tray and the dolly 120 do not interfere with each other in setting the dolly 120 to the stacker 100, and a sufficient height is secured to prevent crushing anything under the stacker tray. Specifically, the height of the regulated area in this embodiment is set to 50 cm or less.

As described above, in the state where the front door 100B is open for the purpose of removing sheets fully stacked on one of the stacker trays, if the other stacker tray that is receiving sheets reaches the upper limit of the regulated area, the regulating unit for the other stacker tray causes the corresponding elevation units 125 to stop moving. In this manner, the downward movement of the other stacker tray can be regulated.

To summarize, in this embodiment, the transmission units for both of the stacker trays are each configured in such a manner that only a driving force of the elevation motor 129 with which the stacker tray is lowered can be transmitted to the stacker tray in the state where the front door 100B is open. Thus, even if the front door 100B is open, sheet stacking can be performed continuously without interruption of the operations performed in the body 901 of the image forming apparatus 900 and the stacker 100. Further, even if a motor or the like causes a malfunction while the front door 100B is open, damage to the stacker 100 can be prevented because the stacker trays cannot mechanically be raised in such a state. Moreover, since the downward movement of the stacker trays can be regulated, reduction in workability and damage to the device can be prevented. In addition, the stacker 100 and the image forming apparatus 900 can be provided in a form suitable for small spaces.

While the above description concerns a case where the transmission unit that transmits the driving force of the elevation motor 129 to the elevation units 125 includes the ratchet wheel 134, the pawl 135, the solenoid 137, the front door microswitch 150, and so forth, the present invention is not limited to such a configuration. As long as the elevation units 125 have a mechanism that only allows downward movement in the state where the front door 100B is open, the same advantageous effect as in the above-described embodiment can be obtained.

While the above description concerns a case where the regulating unit that regulates lowering of the stacker tray includes two microswitches 145 and 150, the present invention is not limited to such a configuration. As long as the elevation units 125 can be raised or lowered freely within the elevation area in the state where the front door 100B is closed, and entrance of the elevation units 125 to a certain area is regulated in the state where the front door 100B is open, the same advantageous effect as in the above-described embodiment can be obtained.

While the above description concerns a case where the sheet conveying path is extended by using the extension rollers 122*a* and 122*b* and the discharge belt 114 in combination, the present invention is not limited to such a configuration. Specifically, it is only necessary that sheets can be conveyed to one of the stacker trays, which are arranged side by side in the sheet discharging direction, positioned on the downstream side in the sheet discharging direction, and that the sheet conveying speed can be reduced during the sheet discharging operation. For example, conveyance of each sheet may be performed by chucking the sheet with a sheet conveying member such as an electrostatic chucking belt or an air chucking belt.

While the above description concerns a case where the stacker includes two stacker trays, the stacker may include three or more stacker trays. Also in such a case, the same advantageous effect as in the above-described embodiment can be obtained. Moreover, since the present invention is directed to prevention of damage to a sheet stacking device occurring when a stacker tray is accidentally raised because of a malfunction of a motor or the like, the present invention can also be applied to a single stacker tray. In that case, similar problems that are expected to occur in checking the state of stacked sheets with the front door being opened can be solved.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-305129 filed Nov. 26, 2007 and No. 2008-267214 filed Oct. 16, 2008, which are hereby incorporated by reference herein in their entirety.

What is claimed is:

1. A sheet stacking device comprising:

a sheet stacking unit provided in a body and configured to be movable upward and downward and to stack the sheets discharged by a discharge portion;

an elevation unit configured to raise and lower the sheet stacking unit;

a door provided on the body and configured to be opened when sheets stacked on the sheet stacking unit are removed;

a detection portion configured to detect the door being open;

a drive source configured to drive the elevation unit; and a transmission unit transmitting a driving force of the drive source to the elevation unit to raise and lower the sheet stacking unit, the transmission unit comprising:

a ratchet provided in a drive force transmitting route to transmit the drive force from the drive source to the elevation unit;

a lock portion configured to be able to regulate the ratchet so as to interrupt a transmission of the drive force to raise the sheet stacking unit when the lock portion contacts the ratchet to regulate the ratchet; and an actuating portion configured to release the lock portion from the ratchet while being supplied with a driving current based on a detection of the door being closed by the detecting portion and to contact the lock portion to the ratchet without being supplied with the driving current based on a detection of the door being open by the detecting portion, wherein, in a state where the door is closed, the actuating portion releases the lock portion from the ratchet to transmit the drive force to the elevation unit to raise and lower the sheet stacking unit via the drive force transmitting route, and in a state where the door is open, the actuating portion brings the lock portion into contact with the ratchet to transmit to the elevation unit only the driving force to lower the sheet stacking unit via the drive force transmitting route.

2. The sheet stacking device according to claim 1, wherein the elevation unit includes a regulating unit configured to regulate a lowering operation of the elevation unit so as to prevent the sheet stacking unit from being lowered beyond a predetermined position in a state where the door is open.

3. The sheet stacking device according to claim 2, wherein the regulating unit includes:

a second detecting portion configured to detect whether the sheet stacking unit, which is being lowered, has reached the predetermined position, and wherein the drive source stops driving the elevation unit if the second detecting portion detects that the sheet stacking unit has reached the predetermined position while the detecting portion detects the door being open.

4. The sheet stacking device according to claim 1, wherein the sheet stacking device includes a plurality of the sheet stacking units to be raised and lowered independently.

5. The sheet stacking device according to claim 1, wherein the actuating portion includes a spring configured to bias the lock portion to separate from the ratchet and a solenoid configured to move the lock portion to contact the ratchet while being supplied with the driving current against a biasing force of the spring.

6. An image forming apparatus comprising:

an image forming unit configured to form an image on a sheet; and the sheet stacking device according to claim 1, wherein the sheet on which the image is formed by the image forming unit is stacked on the sheet stacking unit.

* * * * *